United States Patent [19]

Smith

[11] Patent Number: 4,477,110

[45] Date of Patent: Oct. 16, 1984

[54] DOOR HANDLE CLIP

[75] Inventor: Norman L. Smith, Nepean, Canada

[73] Assignee: Her Majesty the Queen in right of Canada, as represented by the Minister of National Defence, Ottawa, Canada

[21] Appl. No.: 459,963

[22] Filed: Jan. 21, 1983

[30] Foreign Application Priority Data

May 27, 1982 [CA] Canada ..... 403862

[51] Int. Cl.[3] ..... E05C 21/02

[52] U.S. Cl. ..... 292/1; 292/209; 292/DIG. 38

[58] Field of Search ..... 292/1, 209, 19, 17, 292/80, 87, DIG. 38; 211/60 G, 124

[56] References Cited

U.S. PATENT DOCUMENTS

| | | | |
|---|---|---|---|
| 1,691,724 | 11/1928 | Kruschka | 292/17 |
| 3,103,378 | 9/1963 | Ahlgren | 292/17 |
| 4,287,644 | 9/1981 | Durand | 292/318 X |

FOREIGN PATENT DOCUMENTS

| | | | |
|---|---|---|---|
| 402923 | 12/1967 | Australia | 292/17 |

*Primary Examiner*—Richard E. Moore

*Attorney, Agent, or Firm*—Cushman, Darby & Cushman

[57] ABSTRACT

A clip for retaining the door operating lever of the bulkhead door on a ship includes a generally rectangular polyethylene body for mounting on a bracket on the door frame. A keyhole-shaped recess is provided in one side of the body for receiving the lever. A slot in the same side of the body adjacent to the recess facilitates flexing of the sides of the recess so that the lever can enter the circular inner end of the recess.

3 Claims, 3 Drawing Figures

DOOR HANDLE CLIP

This invention relates to a door handle clip, and in particular to a clip for holding the handle or operating lever of a bulkhead door on a ship.

Existing clip arrangements for the handles of watertight ship doors are decidedly unsatisfactory. The arrangements in question have a high failure rate, and require frequent adjustment in order to function properly. Existing clips include a phosphor bronze spring, which requires frequent adjustment to grip the door handle properly.

The object of the present invention is to overcome the problems encountered with the existing door handle clips by providing a relatively simple, inexpensive clip, which is easy to install and which requires relatively little maintenance.

Accordingly the present invention relates to a door handle clip for holding a door operating lever of the type used to open a ship's bulkhead door, said clip comprising a plastic body for mounting on the bracket normally associated with such a door, said body including a recess in one side thereof, for receiving and retaining the lever; and a groove in said one side of the body permitting flexing of one side of said recess, whereby the recess can open to receive the lever.

The invention will now be described in greater detail with reference to the accompanying drawing, which illustrates a preferred embodiment of the invention, and wherein.

PRIOR ART

Figure 1:
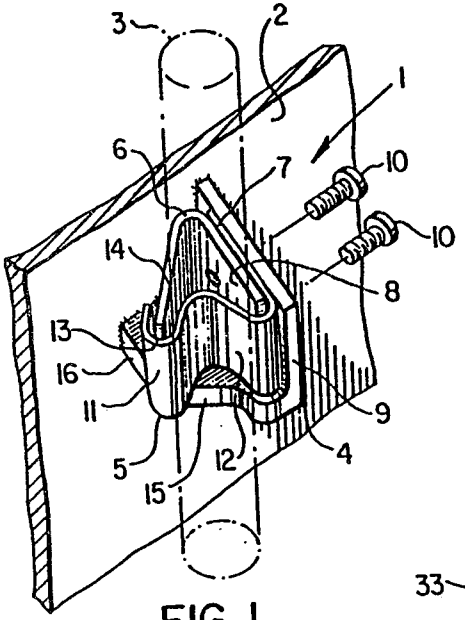
FIG. 1 PRIOR ART
FIG. 1 is a partly exploded, perspective view from above of the existing door handle clip arrangement.

With reference to FIG. 1 of the drawing, the existing clip arrangement generally indicated at 1 is used on a door frame 2 for holding a door operating lever 3 when the door (not shown) is in the open position. The clip arrangement 1 includes an L-shaped mounting bracket 4 extending outwardly from the door frame 2. A flexible metal clip 5 is mounted on the bracket 4 for holding the lever 3. The clip 5 is retained in position by a generally V-shaped plate 6. One arm 7 of the clip 5 is sandwiched between one arm 8 of the plate 6 and vertical arm 9 of the bracket 4. A pair of screws 10 pass through all three arms 7, 8 and 9 to hold the clip 5 in position.

The outer portion 11 of the clip 5 is generally S-shaped, including a deep groove 12 for receiving the lever 3 and a shallow, inwardly opening groove 13 for receiving the outer end of arm 14 of the plate 6. A groove 15 is also provided in the outer end of the horizontal arm 16 of the bracket 4, so that rotation of the handle 3 in a plane parallel to the door frame 2 into and out of the clip 5 is not impeded by the bracket.

It has been found that, with constant use, frequent adjustment of the clip 5 on the bracket 4 is required if the clip arrangement is to function properly. Failure of the clip during use has resulted in minor accidents involving the handle falling from the clip and striking personnel on the head or shoulders.

DETAILED DESCRIPTION OF PRESENT INVENTION

Figure 3:
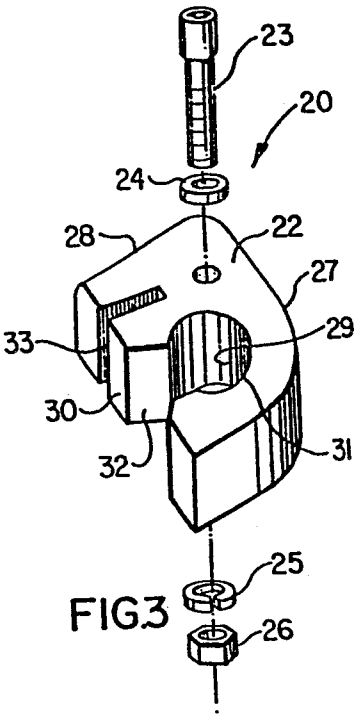
FIG. 3 is an exploded, perspective view from above of the clip of FIG. 2.
Figure 2:
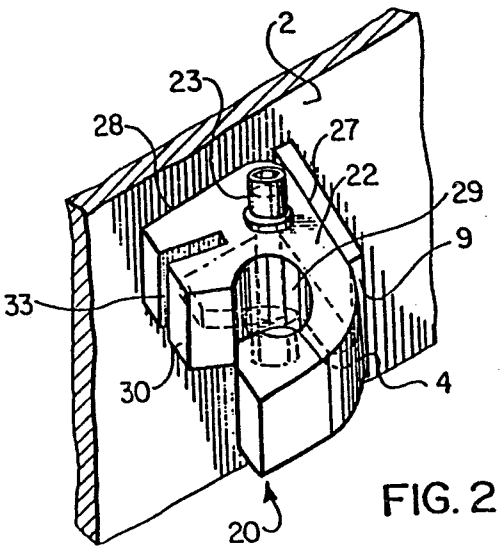
FIG. 2 is a perspective view from above of a door handle clip in accordance with the present invention.

Referring now to FIGS. 2 and 3, the clip of the present invention generally indicated at 20 is used on a bracket 4. The clip 20 includes a plastic, preferably polyethylene, body 22. The body 22 is connected to the bracket 4 by means of a bolt 23, washers 24 and 25 and a nut 26. One side 27 of the body 22 bears against the vertical arm 9 of the bracket 4, and one end 28 of the body bears against the door frame 2. Thus, the body 22 cannot rotate around the axis of the bolt 23.

A large recess 29 is provided in the other side 30 of the body 22 for receiving the lever 3. The recess 29 includes a generally circular inner end 31 and an inwardly tapering entrance 32. The outer end of entrance 32 has a width larger than the diameter of the lever 3, and the width of the inner end of the entrance 32 is smaller than the diameter of the lever 3. A slot 33 is also provided in the side 30 of the body 22. The slot 33 is generally parallel to the recess 29 and permits flexing of one side of the recess. The other side of the recess is sufficiently narrow to flex. Thus, the lever 3 can be inserted into or removed from the recess 29 with relative ease. However, once in the recess 29, the lever 3 cannot fall from the circular inner end 31 because of the narrow inner end of the entrance 32.

The embodiments of the invention in which an exclusive property or privilege is claimed are defined as follows:

1. A door handle clip for holding a generally circular cross-sectional door operating lever of the type used to open a ship's bulkhead door, said clip comprising a plastic body for mounting on a bracket regularly associated with a door frame of the bulkhead door, said body including one end adapted for abutment against the door frame and the mounting bracket and another end for extension beyond the mounting bracket to thereby expose one side of said body to a path of operation of the door lever, said body further including:

means defining a recess in said one side of said body for receiving and retaining a portion of the lever, said recess defining means having (a) a substantially circular inner aperture disposed near said other end and sized to accept said door lever portion therein and (b) an inwardly tapered entrance in communication with said inner aperture, said entrance having an outer end dimension greater than the diameter of said inner aperture and an inner end dimension, adjacent said inner aperture, less than the diameter of said inner aperture; and means defining a groove in said one side of the body and disposed near said one end intermediate said recess defining means and said one end of said body, said groove extending substantially parallel to said inner aperture to establish a flexion arm which is flexibly displaceable between normal and displaced positions, said groove defining means for permitting flexion of said flexion arm to said displaced position to responsively increase said inner end dimension to permit said operating lever to be received by said inner aperture by virtue of said increased inner end dimension, and wherein upon said operating lever being received in said inner aperture, said flexion arm is flexibly displaced to said normal position to reestablish said inner end dimension and to thereby removably retain said operating lever in said inner recess.

2. A clip according to claim 1 wherein said recess defining means is sufficiently close to said other end of said body such that the other side of the recess opposite to said flexion arm can flex for receiving or releasing the lever.

3. The combination comprising:

a ship bulkhead door frame;

a V-shaped mounting bracket having vertical and horizontal support legs each rigidly fixed to said door frame to define a mounting space; and door handle cip means situated in said mounting space for removably retaining a circular cross-sectional door operating lever, said clip means including a clip body having an end surface and a side surface in respective abutment with a portion of said door frame and said vertical leg of said mounting bracket; and elongate mounting means to fix said clip body to said horizontal support leg, pivotal movement of said clip body about said mounting means being prevented due to the respective abutment of said end and side surfaces with said door frame portion and said vertical leg; and wherein said clip body includes:

(a) means defining a recess in a second side surface, opposite to said first-mentioned side surface for receiving and retaining a portion of the lever, said recess defining means haing (i) a substantially circular inner aperture disposed near a second end surface, opposite to said first-mentioned end surface, and sized to accept said door lever portion therein and (ii) an inwardly tapered entrance in communication with said inner aperture, said entrance having an outer end dimension greater than the diameter of said inner aperture and an inner end dimension, adjacent said inner aperture, less than the diameter of said inner aperture, and (b) means defining a groove in said second side surface of the body and disposed near said first-mentioned end surface intermediate said recess defining means and said door frame portion, said groove extending substantially parallel to said inner aperture to establish a flexion arm which is flexibly displaceable between normal and displaced positions, said groove defining means for permitting flexion of said flexion arm to said displaced position to responsively increase said inner end dimension to permit said operating lever to be received by said inner aperture by virtue of said increased inner end dimension, and wherein upon said operating lever being received in said inner aperture, said flexion arm is flexibly displaced to said normal position to reestablish said inner end dimension and to thereby removably retain said operating lever in said inner recess.

* * * * *